US009251737B2

(12) United States Patent
Sun et al.

(10) Patent No.: US 9,251,737 B2
(45) Date of Patent: Feb. 2, 2016

(54) PIXEL CIRCUIT, DISPLAY PANEL AND DISPLAY APPARATUS

(71) Applicant: BOE TECHNOLOGY GROUP CO., LTD., Beijing (CN)

(72) Inventors: Liang Sun, Beijing (CN); Jang Soon Im, Beijing (CN); Lujiang Huangfu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/382,506

(22) PCT Filed: Dec. 5, 2013

(86) PCT No.: PCT/CN2013/088673
§ 371 (c)(1),
(2) Date: Sep. 2, 2014

(87) PCT Pub. No.: WO2015/000261
PCT Pub. Date: Jan. 8, 2015

(65) Prior Publication Data

US 2015/0310807 A1 Oct. 29, 2015

(30) Foreign Application Priority Data

Jul. 2, 2013 (CN) ..... 2013 1 0274893

(51) Int. Cl.
*G09G 3/32* (2006.01)
*G09G 5/10* (2006.01)

(52) U.S. Cl.
CPC ..... *G09G 3/3291* (2013.01); *G09G 3/3233* (2013.01); *G09G 3/3258* (2013.01); *G09G 5/10* (2013.01); *G09G 2300/0426* (2013.01)

(58) Field of Classification Search
None
See application file for complete search history.

(56) References Cited

U.S. PATENT DOCUMENTS 7,193,370 B2 3/2007 Kim
7,652,647 B2 1/2010 Kageyama et al.
(Continued)

FOREIGN PATENT DOCUMENTS

CN 1716370 A 1/2006
CN 1760961 A 4/2006
(Continued)

OTHER PUBLICATIONS

Written Opinion of the International Searching Authority of PCT/CN2013/088673 in English, mailed Apr. 16, 2014.
(Continued)

*Primary Examiner* — John Kirkpatrick
(74) *Attorney, Agent, or Firm* — Collard & Roe, P.C.

(57) ABSTRACT

A pixel circuit, display panel and display apparatus are provided. The pixel circuit comprises a driving sub-circuit, whose first terminal is connected with first reference voltage source via power supply lead, and second terminal is connected with first terminal of a light emitting device; a charging sub-circuit, whose output terminal is connected with third terminal of the driving sub-circuit, which is configured to charge the driving sub-circuit before the driving sub-circuit drives the light emitting device to emit light; and a compensation sub-circuit, whose first terminal is connected with second terminal of the light emitting device, second terminal is connected with second reference voltage source, which is configured to compensate for voltage drop on the power supply lead of voltage which is provided to the driving sub-circuit from the first reference voltage source, so as to raise the uniformity of display brightness within display area of the panel.

14 Claims, 4 Drawing Sheets

(56) References Cited

U.S. PATENT DOCUMENTS

| | | | | |
|---|---|---|---|---|
| 7,978,156 | B2 | 7/2011 | Kim | |
| 2005/0280353 | A1 | 12/2005 | Sun | |
| 2006/0028408 | A1 | 2/2006 | Kim | |
| 2008/0297452 | A1* | 12/2008 | Roush | G09G 3/3233 345/82 |
| 2009/0225013 | A1 | 9/2009 | Lee et al. | |
| 2010/0201674 | A1 | 8/2010 | Kim et al. | |
| 2013/0120342 | A1 | 5/2013 | Wang et al. | |

FOREIGN PATENT DOCUMENTS

| | | | |
|---|---|---|---|
| CN | 1773594 | A | 5/2006 |
| CN | 101800026 | A | 8/2010 |
| CN | 101976546 | A | 2/2011 |
| CN | 103383835 | A | 11/2013 |
| CN | 203480804 | U | 3/2014 |
| EP | 2 216 770 | A1 | 8/2010 |
| KR | 100624137 | B1 | 9/2006 |
| TW | I284875 | B | 8/2007 |
| WO | 2015000261 | A1 | 1/2015 |

OTHER PUBLICATIONS

Search Report of the International Searching Authority of PCT/CN2013/088673 in English, mailed Apr. 16, 2014.

Bibliographic Data of TW200601247 corresponding to TWI284875 Printed on Feb. 2, 2015.

International Search Report, International Preliminary Report on Patentability and Written Opinion of the International Searching Authority of PCT/CN2013/088673 in Chinese, mailed Apr. 16, 2014.

Chinese Office Action of Chinese Application No. 201310274893.4 mailed Dec. 3, 2014 with English translation.

* cited by examiner

PIXEL CIRCUIT, DISPLAY PANEL AND DISPLAY APPARATUS

CROSS REFERENCE TO RELATED APPLICATIONS

This application is the National Stage of PCT/CN2013/088673 filed on Dec. 5, 2013, which claims priority under 35 U.S.C. §119 of Chinese Application No. 201310274893.4 filed on Jul. 2, 2013, the disclosure of which is incorporated by reference. The international application under PCT article 21(2) was not published in English.

TECHNICAL FIELD

The present disclosure relates to the technical field of organic light emitting display, and particularly, to a pixel circuit, a display panel and a display apparatus.

BACKGROUND

An Organic Light Emitting Diode (OLED) display has got a lot of attention at present because it has advantages of a low power consumption, a high brightness, a low cost, a wide angle of view, a rapid response speed, etc, which has been applied widely in a field of the organic light emitting technique.

The OLED display drives a light emitting device to emit light is in a manner of direct-current driving. A capacitor is charged before the light emitting device is driven to emit light, and then a data signal is written into the capacitor; the capacitor is discharged when the light emitting device is driven to emit light for display, a discharging voltage of the capacitor decides the driving current flowing through a driving transistor, and the driving current from the driving transistor drives the light emitting device to emit light.

Generally, in a pixel circuit without any compensation sub-circuit, the driving current $i_d$ driving the light emitting device to emit light is in proportion to $(V_{dd}-V_{ss}-V_{Data}-V_{th})^2$. Wherein the $V_{dd}$ is a high level reference voltage, the $V_{ss}$ is a low level reference voltage, the $V_{Data}$ is a data signal voltage provided by a data line, and the $V_{th}$ is a threshold voltage of the driving transistor.

A pixel structure in the current OLED display has following problems.

Firstly, the plurality of driving transistors for driving the respective light emitting devices to emit light and display on a backboard are non-uniform in the structure because of their manufacture processes and are also non-uniform in their electrical performances and stabilizations, which cause the threshold voltages $V_{th}$ of the respective driving transistors shift with respect to a preset value $V_{th0}$. Secondly, the stabilization of the driving transistor would decrease in a case that the driving transistor has been turned on in the manner of direct-current driving for a long time, such that its threshold voltage $V_{th}$ would also change.

Additionally, with the development of maximization of the OLED size, loads on a signal line become great accordingly and the number of the pixel circuits increases. A same power supply (a power supply providing the high level reference voltage $V_{dd}$) provides power supplies for different pixel circuits, and thus the voltage $V_{dd}$ decreases evidently with the increasing of wirings such that the voltages $V_{dd}$ actually provided to the respective pixel circuits are different from each other. When a same data signal $V_{Data}$ is applied to each pixel circuit, the currents flowing through each OLED in a display area on the backboard are not identical due to the different values of $V_{dd}$, which cause the currents on the backboard to be non-uniform, such that a brightness in an image is non-uniform.

SUMMARY

In order to settle the technical problems existed in the prior art, embodiments of the present disclosure provide a pixel circuit, a display panel and a display apparatus, which are configured to raise the uniformity of a display brightness within a display area of the display panel.

The embodiments of the present disclosure provide a pixel circuit, comprising:

a driving sub-circuit, whose first terminal is connected with a first reference voltage source via a power supply lead, and second terminal is connected with a first terminal of a light emitting device;

a charging sub-circuit, whose output terminal is connected with a third terminal of the driving sub-circuit, which is configured to charge the driving sub-circuit before the driving sub-circuit drives the light emitting device to emit light; and a compensation sub-circuit, whose first terminal is connected with a second terminal of the light emitting device, and second terminal is connected with a second reference voltage source, which is configured to compensate for a voltage drop on the power supply lead of a voltage which is provided to the driving sub-circuit from the first reference voltage source, when the driving sub-circuit drives the light emitting device to emit light.

Optionally, the compensation sub-circuit is a direct-current voltage source, whose positive electrode terminal is connected with the second reference voltage source and negative electrode terminal is connected with the second terminal of the light emitting device, and a voltage provided by the direct-current voltage source is lower than a voltage provided by the second reference voltage source.

Optionally, the direct-current voltage source is an adjustable direct-current voltage source.

Optionally, the driving sub-circuit comprises a driving transistor and a capacitor; and the charging sub-circuit comprises a switch transistor, a data signal source and a gate signal source;

wherein a source of the driving transistor is connected with the first reference voltage source via the power supply lead, a drain thereof is connected with the first terminal of the light emitting device, a gate thereof is connected with a first end of the capacitor and a drain of the switch transistor; a second end of the capacitor is connected with the first reference voltage source; a gate of the switch transistor is connected with the gate signal source, and a source thereof is connected with the data signal source.

Optionally, the driving transistor is a n-type driving transistor or a p-type driving transistor;

when the driving transistor is the n-type driving transistor, the first reference voltage source is a low level voltage source, the second reference voltage source is a high level voltage source, a cathode of the light emitting device is connected with the driving transistor and an anode thereof is connected with the negative electrode terminal of the direct-current voltage source; and when the driving transistor is the p-type driving transistor, the first reference voltage source is the high level voltage source, the second reference voltage source is the low level voltage source, the anode of the light emitting device is connected with the driving transistor and the cathode thereof is connected with the negative electrode terminal of the direct-current voltage source.

The embodiments of the present disclosure provide a display panel comprising a plurality of pixel units arranged in a matrix, each of the pixel units comprises a pixel circuit and a light emitting device connected with the pixel circuit, and the pixel circuit is configured to drive the light emitting device to emit light;

wherein at least one of the pixel circuits corresponding to the plurality of pixel units one-to-one is the pixel circuit with the compensation sub-circuit described above.

Optionally, the pixel circuits corresponding to the pixel units located in a same row one-to-one are the pixel circuit with the compensation sub-circuit described above.

Optionally, the compensation sub-circuits in the pixel circuits corresponding to the pixel units located in the same row one-to-one are a same compensation sub-circuit.

Optionally, the compensation sub-circuit is connected with the light emitting device via a lead, and the lead is disposed in a same layer as any one of gates, gate lines, data lines, sources and drains, the cathode or anode of the light emitting device in the display panel.

The embodiments of the present disclosure further provide a display apparatus comprising the display panel.

In the pixel circuit according to the embodiments of the present disclosure, the compensation sub-circuit is disposed between the light emitting device and the second reference voltage source, which is configured to compensate for an attenuation amount ΔV on the power supply lead of the voltage provided by the first reference voltage source, so that a driving current driving the light emitting device to emit light is irrelative with the attenuation amount ΔV.

DETAILED DESCRIPTION

The embodiments of the present disclosure provide a pixel circuit, a display panel and a display apparatus, which are configure to raise the uniformity of the display brightness within a display area of the display panel.

An Active Matrix Organic Light Emitting Display (AMOLED) panel comprises a plurality of pixel units arranged in a matrix, and each of the pixel units comprises a light emitting device (such as an OLED) and a pixel circuit for driving the light emitting device to emit light.

The pixel circuit comprises a first reference voltage source and a second reference voltage source, which provide operation voltages. Generally, several pixel circuits or all pixel circuits on the display panel share one first reference voltage source and one second reference voltage source. One terminals of the respective pixel circuits are connected with the first reference voltage source, the other terminals are connected with one terminals of the corresponding light emitting devices, the other terminals of the light emitting devices are connected with the second reference voltage source; the first reference voltage source is connected with the plurality of pixel circuits through a plurality of power supply leads arranged in a same direction on the display panel. Because a driving manner of the pixel circuits is a current driving manner, a voltage provided from the first reference voltage source would have a certain attenuation amount on the power supply lead with a certain resistance when the voltage is loaded to the pixel circuit, such that a voltage value actual provided to the pixel circuit from the first reference voltage source is smaller than a preset voltage value. The attenuation amount of the voltage, which is provided from the first reference voltage source, on the power supply lead is defined as ΔV, and a driving current for driving the light emitting device to emit light is associated with the attenuation amount ΔV thereby the existing of the attenuation amount ΔV causes the light emitting device driven by the pixel circuit to emit light abnormally or a low brightness of the emitted light.

In the pixel circuit provided in the embodiments of the present disclosure, a compensation sub-circuit is disposed between the light emitting device and the second reference voltage source, which is configured to compensate an attenuation amount ΔV of the voltage, provided by the first reference voltage source, on the power supply lead, so that the driving current for driving the light emitting device to emit light is independent of the attenuation amount ΔV.

Solutions provided in the embodiments of the present disclosure would be described in details below in connection with drawings.

Figure 1:
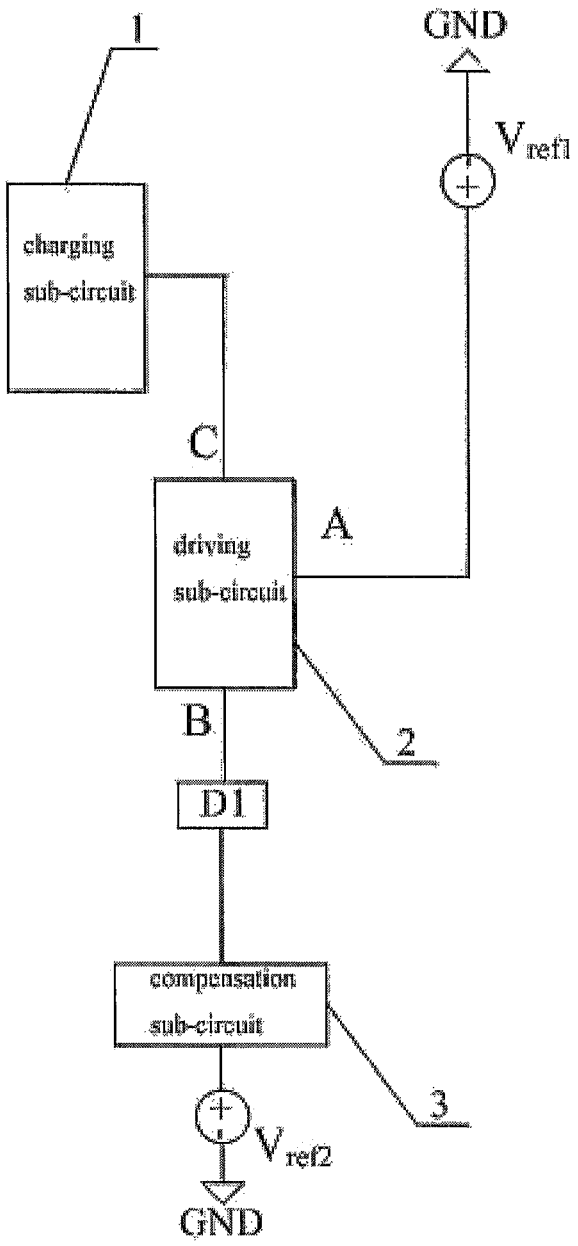
FIG. 1 is a first exemplary view illustrating a structure of a pixel circuit according to embodiments of the present disclosure.

Referring to FIG. 1, a pixel circuit according to the embodiments of the present disclosure comprises:

a charging sub-circuit 1, a driving sub-circuit 2 and a compensation sub-circuit 3;

a first terminal (terminal A) of the driving sub-circuit 2 is connected with a first reference voltage source ($V_{ref1}$), and its second terminal (terminal B) is connected with a first terminal of the light emitting device D1, a second terminal of the light emitting device D1 is connected with a first terminal of the compensation sub-circuit 3, a second terminal of the compensation sub-circuit 3 is connected with the second reference voltage source ($V_{ref2}$); a third terminal (terminal C) of the driving sub-circuit 2 is connected with the charging sub-circuit 1.

The compensation sub-circuit 3 provides a reference voltage $V_{ref3}$ to the second terminal of the light emitting device D1, wherein $V_{ref3}=V_{ref2}-\Delta V$. That is, the compensation sub-circuit 3 compensates for the attenuation amount ΔV of the voltage on the power supply lead, and a voltage value output from the compensation sub-circuit 3 is a voltage value provided for the second terminal of the light emitting device D1, which has been subjected to the voltage compensation.

Alternatively, the light emitting device D1 may be an Organic Light Emitting Diode (OLED) or other light emitting device.

It should be noted that the pixel circuit comprises at least one driving transistor for driving the light emitting device to emit light, and the driving transistor may be a n-type driving transistor or a p-type driving transistor.

When the driving transistor is the n-type driving transistor, the first reference voltage source ($V_{ref1}$) provide a low level voltage $V_{ss}$, and the second reference voltage source ($V_{ref2}$) provides a high level voltage $V_{dd}$, and at this time, the attenuation amount ΔV of the voltage $V_{ss}$, provided by the first reference voltage source $V_{ref1}$, on the power supply lead needs to be compensated for; herein, a cathode of the light emitting device D1 (namely the first terminal of the light emitting device) is connected with the driving sub-circuit, and its anode (namely the second terminal of the light emitting device) is connected with the second reference voltage source ($V_{ref2}$).

When the driving transistor is the p-type driving transistor, the first reference voltage source ($V_{ref1}$) provide the high level voltage $V_{dd}$, and the second reference voltage source ($V_{ref2}$) provides the low level voltage $V_{ss}$, and at this time, the attenuation amount $\Delta V$ of the voltage $V_{dd}$ on the power supply lead needs to be compensated for. Herein, the anode of the light emitting device D1 (namely the first terminal of the light emitting device) is connected with the driving sub-circuit 2, and its cathode (namely the second terminal of the light emitting device) is connected with the second reference voltage source ($V_{ref2}$).

Taking the p-type driving transistor as an example, the first reference voltage source $V_{ref1}$ according to the present embodiment provides the high level voltage $V_{dd}$, the second reference voltage source $V_{ref2}$ provides the low level voltage $V_{ss}$, and the attenuation amount of the $V_{dd}$ on the power supply lead connected to the driving sub-circuit is $\Delta V$; a voltage actually loaded to the anode of the light emitting device D1 from the first reference voltage source $V_{ref1}$ is $V_{dd}-\Delta V$.

The compensation sub-circuit provides the second terminal of the light emitting device with a voltage $V_{ref3}=V_{ss}-\Delta V$, so that the driving current flowing through the light emitting device D1 is in proportion to $((V_{dd}-\Delta V)-(V_{ss}-\Delta V)-V_{Data}-V_{th})^2$, that is, in proportion to $(V_{dd}-V_{ss}-V_{Data}-V_{th})^2$, where the $V_{Data}$ is a data signal voltage provided by the charging sub-circuit and the $V_{th}$ is a threshold voltage of the driving transistor in the driving sub-circuit. That is to say, the compensation sub-circuit compensates for the attenuation amount $\Delta V$ of the $V_{dd}$ on the power supply lead, so that the current flowing through the light emitting device is independent of the attenuation amount $\Delta V$ of the $V_{dd}$ on the power supply lead, that is, the brightness of the light emitting device in the pixel circuit is not affected by the attenuation amount $\Delta V$ of the $V_{dd}$ on the power supply lead.

When performing specific implementations, the reference voltage $V_{ref3}=V_{ss}-\Delta V$, output from the compensation sub-circuit, is a preset value, and an amplitude of $V_{ss}-\Delta V$ may be determined in advance by experience value and/or a visual effect. Specifically, when the brightness in an area corresponding to a certain pixel unit is darker than that of areas corresponding to other pixel units, the compensation sub-circuit according to the present embodiment is disposed for the pixel circuit of that pixel unit and is configured to output a set voltage value according to the experience value, the brightness in the area corresponding to the pixel unit equipped with the compensation sub-circuit is visually measured and the voltage value output from the compensation sub-circuit is adjusted until the brightness in the area corresponding to the pixel unit equipped with the compensation sub-circuit is identical with the brightness in the areas corresponding to the other pixel units, and then the voltage value output from the compensation sub-circuit is determined as the $V_{ss}-\Delta V$. Of course, the determination based on visual effect is only one of the commonly used manners, and the determination may also be made by detecting the emitted light brightness with instruments, thereby no specific limitations are made herein.

Taking the n-type driving transistor as an example, the first reference voltage source $V_{ref1}$ according to the present embodiment provides the low level voltage $V_{ss}$, the second reference voltage source $V_{ref2}$ provides the high level voltage $V_{dd}$, and the attenuation amount of the $V_{ss}$ on the power supply lead connected to the driving sub-circuit is $\Delta V$; a voltage actually loaded to the cathode of the light emitting device D1 from the first reference voltage source $V_{ref1}$ is $V_{ss}-\Delta V$.

The compensation sub-circuit provides the second terminal of the light emitting device with a voltage $V_{dd}-\Delta V$, so that the driving current flowing through the light emitting device is in proportion to $((V_{ss}-\Delta V)-(V_{dd}-\Delta V)-V_{Data}-V_{th})^2$, that is, in proportion to $(V_{ss}-V_{dd}-V_{Data}-V_{th})^2$, where the $V_{Data}$ is the data signal voltage provided by the charging sub-circuit and the $V_{th}$ is a threshold voltage of the driving transistor in the driving sub-circuit. That is to say, the compensation sub-circuit compensated for the attenuation amount $\Delta V$ of the $V_{ss}$ on the power supply lead, so that the current flowing through the light emitting device is independent of the attenuation amount $\Delta V$ of the $V_{ss}$ on the power supply lead, that is, the brightness of the light emitting device in the pixel circuit is not affected by the attenuation amount $\Delta V$ of the $V_{ss}$ on the power supply lead.

When performing specific implementations, the $V_{dd}-\Delta V$ output from the compensation sub-circuit is a preset value, the $V_{dd}$ is known and the amplitude of $\Delta V$ may be determined in advance according to the experience value and/or the visual effect. Detailed description is the same as the above description for the p-type driving transistor, and will not be repeated herein.

Alternatively, the compensation sub-circuit provided in the embodiments of the present disclosure may be, but is not limited to, a direct-current voltage source, by which the second terminal of the light emitting device D1 is provided with the reference voltage $V_{ref3}$.

A positive electrode terminal of the direct-current voltage source is connected with the second reference voltage source, a negative electrode terminal thereof is connected with the second terminal of the light emitting device, and the voltage $V_{ref3}$ provided by the direct-current voltage source is lower than the voltage $V_{ref2}$ provided by the second reference voltage source.

Alternatively, the direct-current voltage source can be an adjustable voltage source. When making specific implementations, the voltage value $V_{ref2}-\Delta V$ output from the compensation sub-circuit is adjusted according to the visual effect and the experience value, so that the brightness of light emitted from the light emitting device D1 is more uniform than the brightness of other light emitting devices. When the direct-current voltage source is the adjustable voltage source, the output reference voltage value $V_{ref3}$ is more flexible, and thus the compensation for the $\Delta V$ of the voltage at the second terminal of the light emitting device is also more flexible.

Figure 2:
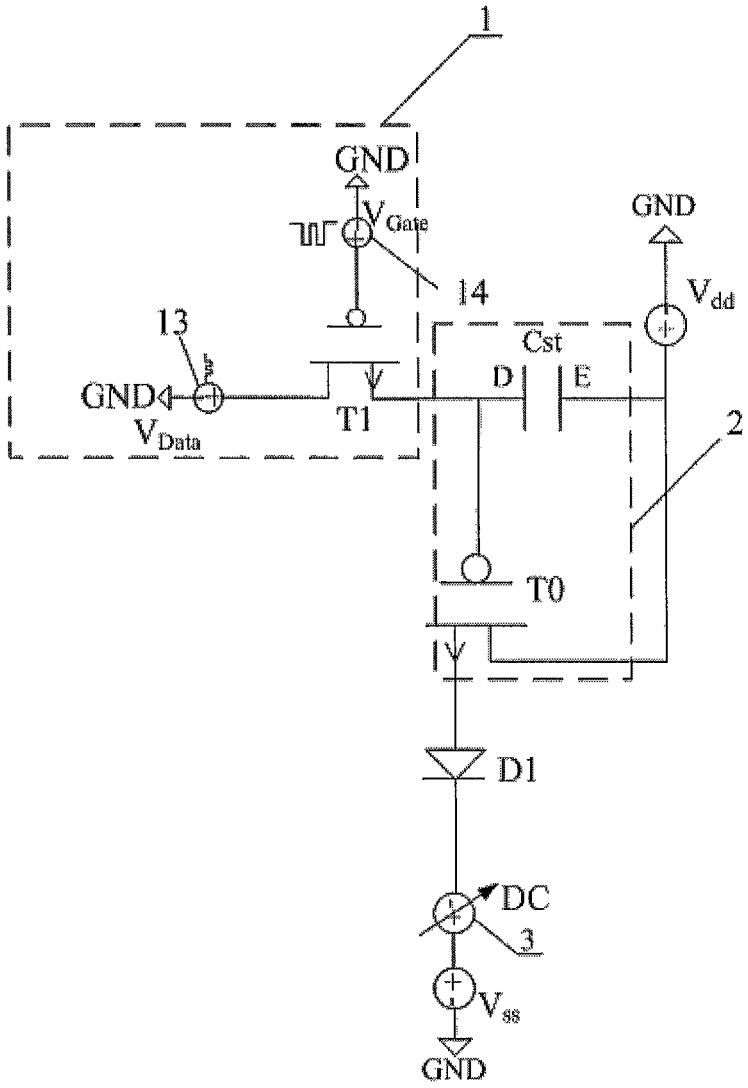
FIG. 2 is a second exemplary view illustrating the structure of the pixel circuit according to the embodiments of the present disclosure.

Referring to FIG. 2, the driving sub-circuit 2 according to the embodiments of the present disclosure comprises:

a driving transistor T0 and a capacitor Cst;

wherein a source of the driving transistor T0 is connected with the output terminal of the first reference voltage source $V_{ref1}$, a drain thereof is connected with the first terminal of the light emitting device D1, a gate thereof is connected with a first end (end D) of the capacitor Cst and the charging sub-circuit 1; a second end (end E) of the capacitor Cst is connected with the output terminal the first reference voltage source $V_{ref1}$.

The charging sub-circuit 1 comprises:

a switch transistor T1, a gate signal source $V_{Gate}$ and a data signal source $V_{Data}$;

a gate of the switch transistor T1 is connected with the gate signal source $V_{Gate}$, a source thereof is connected with the data signal source $V_{Data}$, and a drain thereof is connected with the first end (end D) of the capacitor Cst and the gate of the driving transistor T0.

Figure 3:
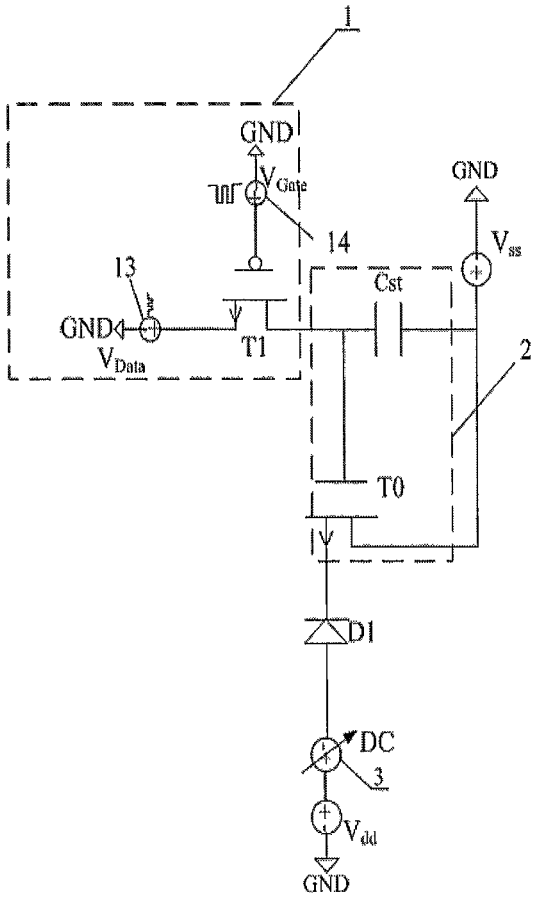
FIG. 3 is a third exemplary view illustrating the structure of the pixel circuit according to the embodiments of the present disclosure.

Alternatively, the driving transistor T0 in the pixel circuit is a n-type driving transistor or a p-type driving transistor. The driving transistor T0 in the pixel circuit illustrated in FIG. 2 is the p-type driving transistor, while the driving transistor T0 in the pixel circuit illustrated in FIG. 3 is the n-type driving transistor.

The switch transistor T1 is a n-type transistor or a p-type transistor.

It should be noted that the pixel circuit according to the embodiments of the present disclosure is not limited to the pixel circuit structure described above, for example, instead of being limited to comprise the one driving transistor, the pixel circuit may also comprise two or more driving transistors each constituting one driving sub-circuit, each of the driving sub-circuits is connected with one light emitting device or more light emitting devices connected in series, and the respective driving sub-circuits operate in turn. Any pixel circuit comprising the compensation sub-circuit according to the embodiments of the present disclosure should be considered as falling into a scope of the present disclosure.

Figure 4:
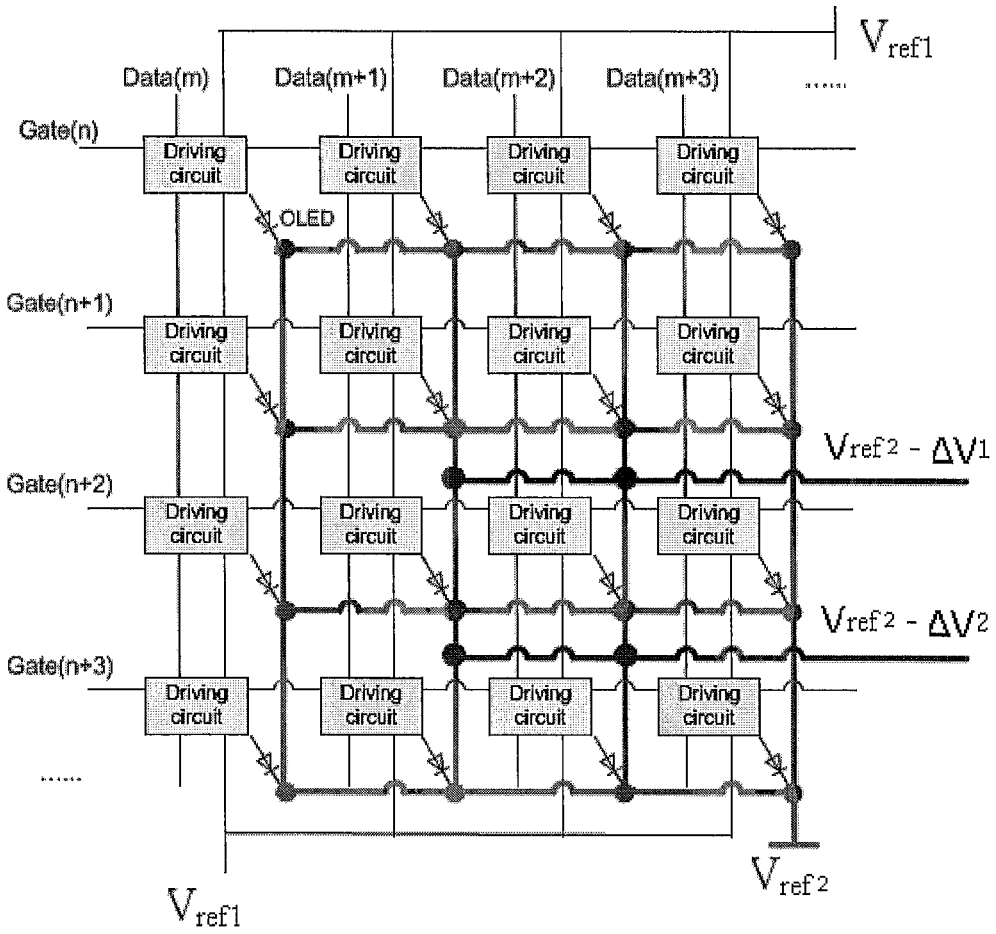
FIG. 4 is an exemplary view illustrating a structure of a display panel according to the embodiments of the present disclosure.

Referring to FIG. 4, the embodiments of the present disclosure further provide a display panel comprising a plurality of pixel units disposed and surrounded by gate lines Gate and data lines Data, which are arranged crossly, a pixel circuit (Driving circuit) and a light emitting device (such as the light emitting diode OLED shown in FIG. 4) connected with the pixel circuit are disposed in each of the pixel unit, and the pixel circuit is configured to drive the light emitting device connected thereto to emit light. Correspondingly, both the pixel circuits and the light emitting devices are also arranged in a matrix. That is to say, the respective pixel circuits are connected to the corresponding light emitting devices one-to-one.

FIG. 4 illustrates four gate lines (Gate(n), Gate(n+1), Gate (n+2) and Gate(n+3)) and four data lines (Data(m), Data(m+1), Data(m+2) and Data(m+3)).

In this example, the pixel circuit equipped with the compensation sub-circuit according to the embodiments of the present disclosure may be disposed in any pixel unit in which a compensation voltage is required, and other pixel circuit can be disposed in the pixel unit in which no compensation voltage is needed. Therefore at least one of the pixel circuits corresponding to the respective pixel units one-to-one is the pixel circuit provided in the embodiments of the present disclosure, namely the pixel circuit equipped with the compensation sub-circuit according to the embodiments of the present disclosure. A part of the pixel circuits can be the pixel circuit without equipping the compensation sub-circuit.

Generally, the first reference voltage source, the second reference voltage source and the compensation sub-circuit configured to compensate for the voltage, which are connected with the pixel circuits are disposed on peripheral areas or a flexible circuit board of the display panel, that is, they are located in non-display areas of the display panel and connected to the plurality of pixel circuits via the power supply leads respectively. In order to simplify the circuit structure, all pixel circuits (that is, the Driving circuits) or a part of the pixel circuits share the first reference voltage source and the second reference voltage source, as illustrated in FIG. 4.

Generally, the display panel comprises a plurality of power supply leads, corresponding to each column of the pixel circuits one-to-one and arranged in a column direction, the pixel circuits located in a same row are correspondingly connected with different power supply leads one-to-one, while the pixel circuits located in a same column share one power supply lead, and the respective power supply leads are connected to the same first reference voltage source. The respective power supply leads have same voltage drops at the pixel circuits in the same row, and the voltage drops lead to a same degree of darkening in the brightness of the light emitting devices located in the same row such that the compensation sub-circuits are disposed for all of the pixel circuits in this row to compensate for the voltage drop. Herein, a plurality of compensation sub-circuits connected with the respective pixel circuits one-to-one can be disposed for the pixel circuits in this row, or the same compensation sub-circuit can be disposed for the respective pixel circuits, that is, the respective pixel circuits share the one compensation sub-circuit.

The first reference voltage source, the second reference voltage source and the compensation sub-circuit provide the first reference voltage $V_{ref1}$, the second reference voltage $V_{ref2}$ and the compensation voltage $V_{ref2}-\Delta V$, respectively.

The first reference voltage source, the second reference voltage source and the compensation sub-circuit are not shown in FIG. 4.

It should be noted that for which pixel circuit the compensation sub-circuit is disposed needs to be decided depending on actual requirements, and the compensation sub-circuit(s) could be disposed in all of the pixel circuits in a certain row far away from the first reference voltage source or could be disposed in a certain pixel circuit individually, as long as the brightness of the light emitted from the areas corresponding to the respective pixel units on the entire display panel is ensured to be uniform substantively.

In a specific implementation process, the compensation sub-circuit(s) is disposed in the pixel circuits on different rows as required.

Alternatively, the lead of the compensation sub-circuit may be a lead which is disposed in the same layer as any one of electrodes or electrode leads such as the gates, the gate lines, the data lines, the sources and drains, the cathodes or anodes, that is, the lead of the compensation sub-circuit is manufactured at a same time when the any one of the above electrodes or electrode leads is manufactured.

Alternatively, the lead of the compensation sub-circuit is connected with the second terminal of the light emitting device, and they are connected with each other through a hole when the lead of the compensation sub-circuit locates on a different layer from the second terminal (the cathode or anode) of the light emitting device when being implemented specifically.

The embodiments of the present disclosure further provide a display apparatus comprising the above display panel. The display apparatus may be an Organic electroluminescence display OLED panel, an OLED display, an OLED television, electrical paper or other display apparatus.

In conclusion, in the pixel circuit according to the embodiments of the present disclosure, there is disposed at the cathode terminal, connected to the pixel circuit, of the light emitting device, the compensation sub-circuit which is configured to compensate for the attenuation amount $\Delta V$ of the voltage $V_{dd}$ at the anode terminal or the attenuation amount $\Delta V$ of the voltage $V_{ss}$ at the cathode terminal of the light emitting device, so that the driving current driving the light emitting device to emit light is irrelative with the attenuation amount $\Delta V$.

It should be noted that there are no significant differences between the drain and the source for the transistor in the display field, and therefore the source of the transistor mentioned in the embodiment of the present disclosure can be its drain and the drain of the transistor can also be its source.

Obviously, those skilled in the art may make various changes and variations on the present disclosure without departing from the spirit and scope of the present disclosure. Thus, the present disclosure intends to cover the changes and variations to the present disclosure if such changes and variations belong to the scope defined by the claims of the present disclosure and equivalent technique thereof.

What is claimed is:

1. A pixel circuit, comprising:

a driving sub-circuit whose first terminal is connected with a first reference voltage source via a power supply lead and second terminal is connected with a first terminal of light emitting device;

a charging sub-circuit whose output terminal is connected with a third terminal of the driving sub-circuit, which is configured to charge the driving sub-circuit before the driving sub-circuit drives the light emitting device to emit light; and a compensation sub-circuit whose first terminal is connected with a second terminal of the light emitting device and second terminal is connected with a second reference voltage source, which is configured to compensate for a voltage drop on the power supply lead of a voltage provided to the driving sub-circuit from the first reference voltage source, when the driving sub-circuit drives the light emitting device to emit light;

wherein the compensation sub-circuit is a direct-current voltage source whose positive electrode terminal is connected with the second reference voltage source and negative electrode terminal is connected with the second terminal of the light emitting device, and a voltage provided by the direct-current voltage source is lower than a voltage provided by the second reference voltage source.

2. The pixel circuit of claim 1, wherein the direct-current voltage source is an adjustable direct-current voltage source.

3. The pixel circuit of claim 2, wherein the driving sub-circuit comprises a driving transistor and a capacitor; and the charging sub-circuit comprises a switch transistor, a data signal source and a gate signal source;

wherein a source of the driving transistor is connected with the first reference voltage source via the power supply lead, a drain thereof is connected with the first terminal of the light emitting device, a gate thereof is connected with a first end of the capacitor and a drain of the switch transistor; a second end of the capacitor is connected with the first reference voltage source; a gate of the switch transistor is connected with the gate signal source, and a source thereof is connected with the data signal source.

4. The pixel circuit of claim 1, wherein the driving sub-circuit comprises a driving transistor and a capacitor; and the charging sub-circuit comprises a switch transistor, a data signal source and a gate signal source;

wherein a source of the driving transistor is connected with the first reference voltage source via the power supply lead, a drain thereof is connected with the first terminal of the light emitting device, a gate thereof is connected with a first end of the capacitor and a drain of the switch transistor; a second end of the capacitor is connected with the first reference voltage source; a gate of the switch transistor is connected with the gate signal source, and a source thereof is connected with the data signal source.

5. The pixel circuit of claim 1, wherein the driving sub-circuit comprises a driving transistor and a capacitor; and the charging sub-circuit comprises a switch transistor, a data signal source and a gate signal source;

wherein a source of the driving transistor is connected with the first reference voltage source via the power supply lead, a drain thereof is connected with the first terminal of the light emitting device, a gate thereof is connected with a first end of the capacitor and a drain of the switch transistor; a second end of the capacitor is connected with the first reference voltage source; a gate of the switch transistor is connected with the gate signal source, and a source thereof is connected with the data signal source.

6. The pixel circuit of claim 5, wherein the driving transistor is a n-type driving transistor or a p-type driving transistor;

when the driving transistor is the n-type driving transistor, the first reference voltage source is a low level voltage source, the second reference voltage source is a high level voltage source, a cathode of the light emitting device is connected with the driving transistor, and an anode thereof is connected with the negative electrode terminal of the direct-current voltage source; and when the driving transistor is the p-type driving transistor, the first reference voltage source is the high level voltage source, the second reference voltage source is the low level voltage source, the anode of the light emitting device is connected with the driving transistor, and the cathode thereof is connected with the negative electrode terminal of the direct-current voltage source.

7. A display panel comprising a plurality of pixel units arranged in a matrix, each of the pixel units comprises a pixel circuit and a light emitting device connected with the pixel circuit, and the pixel circuit is configured to drive the light emitting device to emit light;

wherein at least one of the pixel circuits corresponding to the plurality of pixel units one-to-one is the pixel circuit with the compensation sub-circuit of claim 1.

8. The display panel of claim 7, wherein the pixel circuits corresponding to the pixel units located in a same row one-to-one are the pixel circuit with the compensation sub-circuit of claim 1.

9. The display panel of claim 8, wherein the compensation sub-circuits in the pixel circuits corresponding to the pixel units located in the same row one-to-one are a same compensation sub-circuit.

10. The display panel of claim 9, wherein the compensation sub-circuit is connected with the light emitting device via a lead, and the lead is disposed in a same layer as any one of gates, gate lines, data lines, sources and drains, the cathode or anode of the light emitting device in the display panel.

11. A display apparatus comprising the display panel of claim 7.

12. The display apparatus of claim 11, wherein the direct-current voltage source is an adjustable direct-current voltage source.

13. The display panel of claim 7, wherein the direct-current voltage source is an adjustable direct-current voltage source.

14. The display panel of claim 7, wherein the pixel circuits corresponding to the pixel units located in a same row one-to-one are the pixel circuit with the compensation sub-circuit of claim 3.

* * * * *